US012378684B2

(12) United States Patent
Akolkar et al.

(10) Patent No.: US 12,378,684 B2
(45) Date of Patent: Aug. 5, 2025

(54) DIMENSIONALLY STABLE ANODE FOR ELECTROLYTIC CHLORINE EVOLUTION IN MOLTEN SALTS

(71) Applicant: CASE WESTERN RESERVE UNIVERSITY, Cleveland, OH (US)

(72) Inventors: Rohan Akolkar, Cleveland, OH (US); Benjamin P. Holcombe, Cleveland, OH (US); Nicholas Sinclair, Cleveland, OH (US); Ruwani Wasalathanthri, Cleveland, OH (US)

(73) Assignee: CASE WESTERN RESERVE UNIVERSITY, Cleveland, OH (US)

( * ) Notice: Subject to any disclaimer, the term of this patent is extended or adjusted under 35 U.S.C. 154(b) by 0 days.

(21) Appl. No.: 18/363,163

(22) Filed: Aug. 1, 2023

(65) Prior Publication Data

US 2024/0158935 A1 May 16, 2024

Related U.S. Application Data

(60) Provisional application No. 63/383,098, filed on Nov. 10, 2022.

(51) Int. Cl.

| | |
|---|---|
| ***C25B 11/077*** | (2021.01) |
| ***C25B 1/26*** | (2006.01) |
| ***C25B 9/09*** | (2021.01) |
| ***C25B 11/065*** | (2021.01) |

(52) U.S. Cl.

CPC ..... *C25B 11/077* (2021.01); *C25B 1/26* (2013.01); *C25B 9/09* (2021.01); *C25B 11/065* (2021.01)

(58) Field of Classification Search

None

See application file for complete search history.

(56) References Cited

U.S. PATENT DOCUMENTS

| | | | | | |
|---|---|---|---|---|---|
| 2,752,303 | A * | 6/1956 | Cooper | C25C 7/005 | 205/370 |
| 3,711,385 | A * | 1/1973 | Beer | C25B 11/093 | 427/126.6 |
| 3,725,222 | A * | 4/1973 | Russell | C25C 3/18 | 205/394 |
| 4,039,401 | A * | 8/1977 | Yamada | C25C 3/06 | 205/384 |
| 4,360,417 | A * | 11/1982 | Reger | C25B 11/093 | 204/290.13 |
| 4,440,610 | A * | 4/1984 | Dawless | C25C 3/18 | 205/372 |
| 4,584,084 | A * | 4/1986 | Asano | C25C 7/02 | 427/126.6 |
| 5,118,396 | A * | 6/1992 | Claus | C25C 3/34 | 205/363 |
| 6,572,758 | B2 * | 6/2003 | Zolotarsky | C25B 1/265 | 204/290.01 |
| 2015/0203979 | A1 * | 7/2015 | Seetharaman | C25C 3/34 | 75/392 |

FOREIGN PATENT DOCUMENTS

| | | | | |
|---|---|---|---|---|
| EP | 1511105 | A1 * | 3/2005 | H01M 4/8652 |

* cited by examiner

*Primary Examiner* — Louis J Rufo

(74) *Attorney, Agent, or Firm* — Tarolli, Sundheim, Covell & Tummino LLP

(57) ABSTRACT

An anode for electrolytic chlorine evolution in a molten salt electrolyte includes a graphite substrate and a coating including a transition metal oxide disposed on at least a portion of the substrate.

11 Claims, 4 Drawing Sheets

DIMENSIONALLY STABLE ANODE FOR ELECTROLYTIC CHLORINE EVOLUTION IN MOLTEN SALTS

RELATED APPLICATION

This application claims priority from U.S. Provisional Application No. 63/383,098, filed Nov. 10, 2022, the subject matter of which is incorporated herein by reference in its entirety.

GOVERNMENT FUNDING

This invention was made with government support under DE-AC02-07CH11358 awarded by the Department of Energy. The government has certain rights in the invention.

BACKGROUND

Graphite is the de facto anode in molten halide systems for either the production of chlorine gas in chloride melts, or as a consumable anode in oxide and oxy-fluoride melts as in the ALCOA process for Al electrowinning or the traditional electrolysis of neodymium oxide to neodymium metal. For chlorine evolution, the large anode overpotential on graphite is a major issue and is often cited as a prohibitive factor in process viability for chloride melt electrolysis due to the increased energy consumption and associated operating costs.

The chlor-alkali industry was revolutionized in the middle of the 20th century with the advent of the Dimensionally Stable Anode (DSA) which was composed of Mixed Metal Oxides (MMO) sintered onto a titanium current collector. The "dimensionally stable" moniker refers to the non-consumable nature of the electrode during electrochemical processing. These chlor-alkali DSAs also brought a significant reduction in anodic overpotential for chlorine evolution and oxygen evolution in electrolytic cells, which utilize aqueous electrolytes. The present invention addresses the challenge of developing a DSA electrode that operates in extreme conditions of non-aqueous molten salt media. Molten salts are significantly aggressive compared to aqueous media, given their higher operating temperatures, their highly corrosive nature, and the higher chlorine evolution rates that they need to support.

At present, industrial metal recovery and purification suffer from the environmental malignity of their byproducts ($CO_2$, CO, PFC) and certain critical materials can simply not be produced domestically by those processes. An example is rare-earth metal production using electrowinning with a fluoride-containing electrolyte. Electrowinning of Nd can generate perfluorocarbons (PFCs) via the reaction between the graphite anode and the fluoride-containing electrolyte. Accordingly, the conventional fluoride-based molten salt electrolysis route for neodymium and other rare earth metal production is not attractive from a sustainability point-of-view because of harmful $CO_2$ and perfluorocarbon gas emissions and the energy-intensive nature of this process.

SUMMARY

Embodiments described herein relate to a non-consumable or dimensionally stable anode, its use in electrolytic chlorine gas evolution in non-aqueous molten salts, and particularly its use in a device, system, and process for the production, extraction, or recovery of metal(s) from a metal bearing material using chloride molten salt electrolysis. We found that transition metal oxide coated anodes, such as ruthenium dioxide ($RuO_2$) coated anodes, are catalytic to and reduce the overpotential for electrolytic chlorine gas evolution in a chloride containing molten salt media of an electrochemical cell used for molten salt electrolysis of metal chlorides. Transition metal oxides, such as $RuO_2$, cannot be readily fabricated into anodes because of mechanical difficulties and therefore must be coated onto a chemically and mechanically stable current collector, such as graphite/carbon current collectors. Graphite substrates advantageously can be adaptable to various geometric configurations ranging from solids to amorphous cloths. Also, $RuO_2$ coatings can be readily applied onto graphitic substrates using benign and low-cost techniques, such as electrodeposition. Combining the electrocatalytic effect of transition metal oxides, such as $RuO_2$, and graphite substrates can result in anodes with improved energy efficiency for the co-production of metals and chlorine gas in moderate or high-temperatures chloride molten salt electrolysis.

In some embodiments, a dimensionally stable anode that is configured to produce chlorine gas during electrolysis in a molten mixture of at least about 50 mol % chloride containing fused salts can include a graphite substrate and an electrochemically active coating, which is catalytic to chlorine gas evolution, disposed on at least a portion of the substrate. The coating on at least a portion of the graphite substrate that is catalytic to chlorine gas evolution includes at least one electrochemically active transition metal oxide.

In some embodiments, the electrochemically active coating can further include at least one oxide of an alkali metal, an alkaline earth metal, a post-transition metal, a metalloid/semi-metal, a non-metal, a lanthanoid/lanthanide, an actinoid/actinide, or mixtures thereof.

In another embodiment, the electrochemically active coating can further include at least one transition metal, alkali metal, alkaline earth metal, post-transition metal, metalloid/semi-metal, non-metal, lanthanoid/lanthanide, actinoid/actinide or mixtures thereof.

In some embodiments, the transition metal oxide includes $RuO_2$ and optionally $IrO_2$.

In other embodiments, the electrochemically active coating includes at least about 10% by weight, at least about 15% by weight, at least about 20% by weight, at least about 25% by weight, at least about 30% by weight, at least about 35% by weight, at least about 40% by weight, at least about 45% by weight, at least about 50% by weight, at least about 55% by weight, at least about 60% by weight, at least about 65% by weight, at least about 70% by weight, at least about 75% by weight, at least about 80% by weight, at least about 85% by weight, at least about 90% by weight, at least about 95% by weight, or at least about 99% by weight $RuO_2$.

In some embodiment, the electrochemically active coating has a geometric surface coverage ratio of the substrate surface of about 0.000001:1 to 1:1.

In another embodiment, the dimensionally stable anode has electrochemically active surface area to geometric surface area ratio of about 0.000001:1 to about 10,000:1

In some embodiments, the electrochemically active coating can have a thickness of about $10^{-9}$ m to about $10^{-2}$ m.

In some embodiments, the transition metal oxide can be sputtered on a surface of the graphite substrate.

In other embodiments, the transition metal oxide can be sintered on a surface of the graphite substrate.

In still other embodiments, the transition metal oxide can include dip coated trivalent ruthenium that is oxidized.

In yet other embodiments, the transition metal oxide can be electrodeposited ruthenium that is oxidized by, for example, annealing in an oxygen containing environment.

In some embodiments, the electrochemically active coating includes at least two layers having differing compositions.

Other embodiments described herein relate to an electrochemical cell for electrolytically generating chlorine gas and one or more metal cathode product(s). The electrochemical cell includes a dimensionally stable anode as recited herein and a cathode positioned in a molten mixture of at least about 50 mol % chloride containing fused salts. During electrolysis chlorine gas is produced at the anode and metal cathode product(s) are produced at the cathode.

In some embodiments, metal cathode product(s) can include at least one of alkali metal, alkaline earth metal, transition metal, post-transition metal, metalloid/semimetal, lanthanoid/lanthanide, actinoid/actinide, or combinations thereof.

In some embodiments, the cathode product(s) are in solid, liquid, or gas phase.

In some embodiments, the anode produces chlorine gas without the interruption of current from external electrical circuitry for any period of time exceeding 1 second.

In other embodiments, the cathode product(s) are produced without the interruption of current from external electrical circuitry for any period of time exceeding 1 second.

Is some embodiments, the cathode can include an inert material, such as tungsten and molybdenum.

In some embodiments, the balance of the fused salt can include a single electrolyte or mixture of electrolytes where the anion is a carbonate, sulfate, phosphate, fluoride, bromide, iodide, or hydroxide.

In other embodiments, the balance of the fused salt can include at least one of an inorganic oxide, nitride, carbide, phosphide, or sulfide.

In some embodiments, the molten mixture can include chemically bound or unbound water molecules.

In some embodiments, the molten mixture containing the fused salts is electrolyzed at a temperature of about 25° C. to about 3000° C.

In some embodiments, the molten mixture can include a eutectic of at least two of LiCl, KCl, NaCl, CsCl, $MgCl_2$, $BaCl_2$, $SrCl_2$, or $CaCl_2$ and the electrolysis is conducted at a temperature of about 400° C. to about 800° C.

In other embodiments, the molten mixture can include a eutectic of $SrCl_2$, $BaCl_2$, and optionally at least one of LiCl, KCl, NaCl, CsCl, $MgCl_2$, or $CaCl_2$ and the electrolysis is conducted at a temperature of about 800° C. to about 3000° C.

In some embodiments, the electrochemical cell is configured for continuous electrolysis.

In some embodiments, the continuous electrolysis can include continuous input of metal containing feedstock into the cell, continuous production of chlorine gas and metal cathode product(s), and/or continuous collection of the produced metal cathode product(s) from the cell.

In some embodiments, the continuous input of metal containing feedstock can be achieved through a variety of means, such as a refractory ceramic or metal screw feeder or conveyer or funneling system or slider bearing type assembly whereby the rate of input of the metal containing feedstock can be modulated to increase, decrease or maintain bulk concentration based on optimizing reaction conditions for higher throughput. For example, the rate of input of the metal containing feedstock can be modulated to optimize production of metal cathode product(s) and optionally chlorine gas.

In other embodiments, the continuous collection of the metal cathode product(s) can minimize the metal cathode product(s) contact with cations of the same metal while not be being held under a deposition potential. The continuous collection of metal cathode product(s) can be achieved by drawing, valving, pumping, capillary feed, or slider bearing like mechanisms. An example of such a collection system is a refractory valve or spout controlled by a stepper motor or similar control system which siphons the metal into a refractory collection vessel or a partially consumable vessel of suitable alloying or compositing material.

Another method by which continuous drawing of metal cathode product(s) can be achieved is by use of a refractory metal or ceramic which does not combine chemically with the metallic material and which is allowed to fuse in a tube of the refractory material and subsequently drawn off by induction remelting under inert blanket, vacuum or under air atmospheres.

In some embodiments, the anode can have a cylindrical, planar, spherical, bipolar, stacked, or other complex geometry and include a single anode or an array of anodes.

In other embodiments, the geometric surface area ratio of anode to cathode can be about 0.5:1 to about 1000:1.

In some embodiments, the electrochemical cell further includes a porous separator or diaphragm positioned between and separating the anode and cathode. The separator or diaphragm can inhibit redox shuttling and back reaction between metal plated on the cathode and chlorine gas generated at the anode.

In some embodiments, the separator or diaphragm includes a ceramic with a porosity of about 10% to about 60%.

In some embodiments, the electrochemical cells include a means for supplying current effective for molten salt electrolysis of the metal chloride(s) to metal and chlorine gas. The current means can supply current at a current density of about 50 $mA/cm^2$ to about 1,000 $A/cm^2$.

In other embodiments, the electrochemical cell can include a means for mixing, agitating, and/or flowing the fused salt mixture in the cell.

In some embodiments, the cathode products are formed from complex ion or non-complex ions in the fused salt mixture.

In other embodiments, the electrochemical cell produces substantially no $CO_2$ or perfluorocarbon emissions during operation.

Other embodiments described herein relate to a method of electrowinning. The method includes contacting the dimensionally stable described herein with a molten mixture of at least about 50 mol % chloride containing fused salts. The electrolysis of the molten mixture generates chlorine gas at the electrode that can then be collected.

DETAILED DESCRIPTION

Embodiments described herein relate to a non-consumable or dimensionally stable anode, its use in electrolytic chlorine gas evolution in non-aqueous molten salts, and particularly its use in a device, system, and process for the production, extraction, or recovery of metal(s) from a metal bearing material using chloride molten salt electrolysis. We found that transition metal oxide coated anodes, such as ruthenium dioxide ($RuO_2$) coated anodes, are catalytic to and reduce the overpotential for electrolytic chlorine gas evolution in a chloride containing molten salt media of an electrochemical cell used for molten salt electrolysis of metal chlorides. Transition metal oxides, such as $RuO_2$, cannot be readily fabricated into anodes because of mechanical difficulties and therefore must be coated onto a chemically and mechanically stable current collector, such as graphite/carbon current collectors. Graphite substrates, advantageously, can be adaptable to various geometric configurations ranging from solids to amorphous cloths. Also, $RuO_2$ coatings can be readily applied onto graphitic substrates using benign and low-cost techniques such as electrodeposition. Combining the electrocatalytic effect of transition metal oxides, such as $RuO_2$, and graphite substrates can result in anodes with improved energy efficiency for the co-production of metals and chlorine gas in moderate or high-temperatures chloride molten salt electrolysis.

Figure 1:
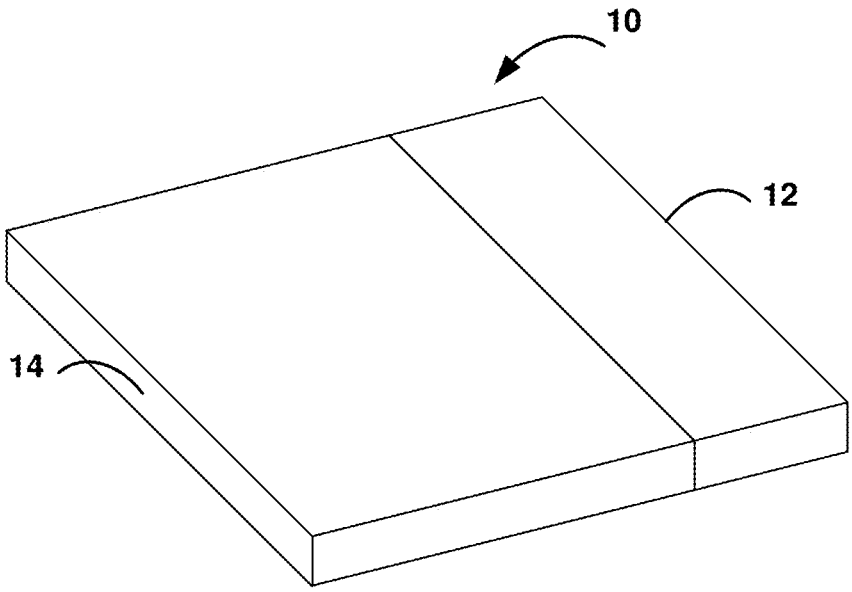
FIG. 1 is a schematic illustration of dimensionally stable anode in an accordance with an embodiment.

FIG. 1 is a schematic illustration of a non-consumable or dimensionally stable anode 10 that is configured to produce chlorine gas during chlorine molten salt electrolysis in a molten mixture of at least about 50 mol % chloride containing fused salts. The term "chloride containing fused salts" refers to any inorganic substance where upon heating, an ionically conductive liquid is produced where one of the atomic components of the substance is the chlorine atom in any of its valances wherein it may be a chloride ion or ion containing the chlorine atom (e.g., $Cl^-$ or $OCl^-$).

The dimensionally stable anode 10 includes a graphite substrate 12 and an electrochemically active coating 14 disposed on at least a portion of the substrate 12 that is catalytic to chlorine gas evolution in a chloride containing molten salt media during chlorine molten salt electrolysis. While the graphite substrate 12 is illustrated as being plate-shaped, the graphite substrate 12 can include in various other shapes, such as three-dimensional structure that is net-shaped, bar-shaped, sheet-shaped, tubular, linear, porous plate-shaped, porous, or spherical. The graphite substrate 12 can further be in the form of a fibrous graphite mesh, graphite fibers, graphite felt or fabric, and the like.

In some embodiments, the graphite substrate 12 can be configured to enable the chloride molten salt to flow through it. As used herein, the term "flow-through anode" refers to an anode so configured to allow flow of the molten salt electrolyte through the anode. Possible configurations can include a porous graphite substrate, a graphite mesh, a perforated graphite sheet, planar configuration, and multi-planar geometric configurations.

The coating 14 disposed on the at least portion of the graphite substrate 12 that is catalytic to chlorine gas evolution includes at least one electrochemically active transition metal oxide. Examples of electrochemically active transition metal oxides include oxides of platinum, palladium, ruthenium, iridium, other Group VIII metal oxides, or mixtures thereof. In some embodiments, the electrochemically active transition metal oxide that is catalytic to chloride gas evolution can include ruthenium oxide ($RuO_2$) and optionally iridium oxide ($IrO_2$).

The electrochemically active transition metal oxide of the coating can be substantially amorphous, substantially crystalline, or a blend thereof. In some embodiment where $RuO_2$ is used as the electrochemically active transition metal oxide, the $RuO_2$ is substantially amorphous. Amorphous $RuO_2$ in the electrochemically active coating has higher catalytic activity for chlorine evolution than crystalline $RuO_2$, thereby rendering an anode having a low chlorine evolution potential and capable of promoting chlorine evolution in a chloride containing molten salt media.

In some embodiment, the electrochemically active coating 14 can include at least about 10% by weight, at least about 15% by weight, at least about 20% by weight, at least about 25% by weight, at least about 30% by weight, at least about 35% by weight, at least about 40% by weight, at least about 45% by weight, at least about 50% by weight, at least about 55% by weight, at least about 60% by weight, at least about 65% by weight, at least about 70% by weight, at least about 75% by weight, at least about 80% by weight, at least about 85% by weight, at least about 90% by weight, at least about 95% by weight, or at least about 99% by weight $RuO_2$.

In some embodiments, the balance of the coating 14 including $RuO_2$ can include an additional transition metal oxide, such as $IrO_2$. For example, a coating including $RuO_2$ can also include up to 1% by weight, up to 5% by weight, up to 10% by weight, up to 15% by weight, up to 20% by weight, up to 25% by weight, up to 30% by weight, up to 35% by weight, up to 40% by weight, up to 45% by weight, up to 50% by weight, up to 55% by weight, up to 60% by weight, up to 65% by weight, up to 70% by weight, up to 75% by weight, up to 80% by weight, up to 85% by weight, or up to 90% by weight $IrO_2$.

In other embodiments, the balance of the coating 14 including a transition metal oxide, such as $RuO_2$ and/or $IrO_2$, can include at least one oxide of an alkali metal, an alkaline earth metal, a post-transition metal, a metalloid/semi-metal, a non-metal, a lanthanoid/lanthanide, an actinoid/actinide, or mixtures thereof and/or at least one transition metal, alkali metal, alkaline earth metal, post-transition metal, metalloid/semi-metal, non-metal, lanthanoid/lanthanide, actinoid/actinide or mixtures thereof. For example, a coating including a transition metal oxide, such as $RuO_2$ and/or $IrO_2$, can also include up to 1% by weight, up to 5% by weight, up to 10% by weight, up to 15% by weight, up to 20% by weight, up to 25% by weight, up to 30% by weight, up to 35% by weight, up to 40% by weight, up to 45% by weight, up to 50% by weight, up to 55% by weight, up to 60% by weight, up to 65% by weight, up to 70% by weight, up to 75% by weight, up to 80% by weight, up to 85% by weight, or up to 90% by weight of at least one oxide of an alkali metal, an alkaline earth metal, a post-transition metal, a metalloid/semi-metal, a non-metal, a lanthanoid/lanthanide, an actinoid/actinide, or mixtures thereof and/or at least one transition metal, alkali metal, alkaline earth metal, post-transition metal, metalloid/semi-metal, non-metal, lanthanoid/lanthanide, actinoid/actinide or mixtures thereof.

In some embodiments, the electrochemically active coating 14 can have a geometric surface coverage ratio of the anode of about 0.000001:1 to about 1:1. For example, the electrochemically active coating can have geometric coverage ratio of about 0.00001:1 to about 1:1, about 0.0001:1 to about 1:1, about 0.001:1 to about 1:1, about 0.01:1 to about 1:1, about 0.1:1 to about 1:1, about 0.2:1 to about 1:1, about 0.3:1 to about 1:1, about 0.4:1 to about 1:1, about 0.5:1 to about 1:1, about 0.6:1 to about 1:1, about 0.7:1 to about 1:1, about 0.8:1 to about 1:1, or about 0.9:1 to about 1:1.

In other embodiments, the anode 10 can have an a electrochemically active surface area to geometric surface area ratio of about 0.000001:1 to about 10,000:1. For example, the anode can have an a electrochemically active surface area to geometric surface area ratio of about of about 0.00001:1 to about 10,000:1, about 0.0001:1 to about 10,000:1, about 0.001:1 to about 10,000:1, about 0.01:1 to about 10,000:1, about 0.1:1 to about 10,000:1, about 1:1 to about 10,000:1, about 10:1 to about 10,000:1, about 100:1 to about 10,000:1, or about 1000:1 to about 10,000:1.

In some embodiments, the coating 14 can have a thickness of about $10^{-9}$ m to about $10^{-2}$ m. For example, the electrochemically active surface coating can have a substantially uniform thickness of about $10^{-8}$ m to about $10^{-2}$ m, about $10^{-7}$ m to about $10^{-6}$ m, about $10^{-5}$ m to about $10^{-4}$ m, about $10^{-3}$ m to about $10^{-2}$ m, about $10^{-9}$ m to about $10^{-1}$ m, about $10^{-9}$ m to about $10^{-3}$ m, about $10^{-9}$ m to about $10^{-4}$ m, about $10^{-9}$ m to about $10^{-5}$ m, about $10^{-9}$ m to about $10^{-6}$ m, about $10^{-9}$ m to about $10^{-7}$ m, or about $10^{-9}$ m to about $10^{-8}$ m.

In other embodiments, the coating 14 can be provided on at least a portion of the surface of the graphite substrate at a surface density of about 10 m/cm$^2$ to about 1000 m/cm$^2$. For example, the coating can have substantially uniform surface density of about 20 m/cm$^2$ to about 900 m/cm$^2$, about 30 m/cm$^2$ to about 800 m/cm$^2$, about 40 m/cm$^2$ to about 800 m/cm$^2$, about 50 m/cm$^2$ to about 700 m/cm$^2$, about 60 m/cm$^2$ to about 700 m/cm$^2$, about 70 m/cm$^2$ to about 600 m/cm$^2$, or about 80 m/cm$^2$ to about 700 m/cm$^2$.

The coating 14 can be provided as a single layer having the same or uniform composition or as multiple layers having the same or differing compositions. In some embodiments, the coating 14 can include two layers with differing compositions. For example, an intermediate layer (not shown) can be formed between a catalytic layer and the graphite substrate. This arrangement can prevent the chloride containing molten salt media from reaching the graphite substrate even when the chloride containing molten salt media penetrates into the catalytic layer.

The intermediate layer can be made of, for example, a metal, alloy, a carbon based material, such as boron doped diamond, a metal compound, such as an oxide and sulfide, or a composite compound, such as a metal composite oxide. For example, the intermediate layer can be formed of a metal, in the case of which a thin film of tantalum or niobium, etc., may be employed. The intermediate layer can also be formed of an alloy that includes, for example, tantalum, niobium, tungsten, molybdenum, titanium, or platinum. Furthermore, an intermediate layer made of a carbon based material, such as boron doped diamond also has the same effects.

In other embodiments, the coating 14 can have a substantially uniform thickness across at least the portion of graphite substrate on which it is disposed or have a non-uniform thickness. The coating can also be porous and/or include non-contiguous portions across portions of the graphite substrate.

Figure 4:
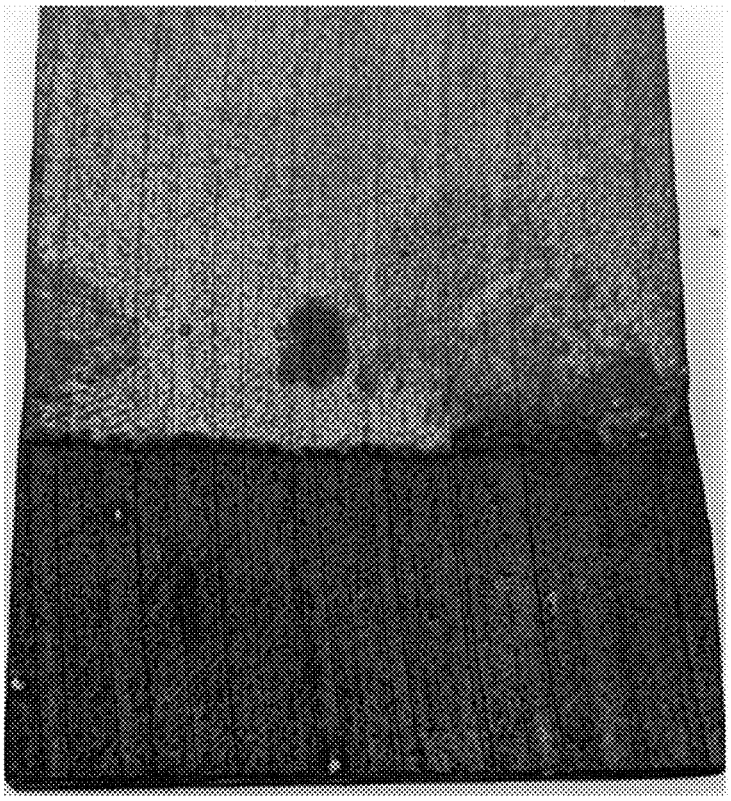
FIG. 4 is an image of a dimensionally stable anode that includes $RuO_2$ on a graphite substrate (Ru loading about 0.4 $mg/cm^2$).

In some embodiments, the electrochemically active coating 14 can be provided on a portion of the surface of the graphite substrate 12 by electrodepositing at least one transition metal, such as ruthenium, and optionally other metals, and annealing the electrodeposited transition metal and optional other metals in an atmosphere and at a temperature effective to oxidize the electrodeposited transition metal. Advantageously, electrodeposition of transition metals, such as ruthenium, allows the production of electrochemically active coating on the graphite substrate in a facile manner with small amounts of cost prohibitive trivalent ruthenium plating solution and with greater control of both thickness and distribution of the catalytic coating. Furthermore, the electrolytic method does not require the use of high temperatures, high pressures, nor strong oxidizers to produce positive results. By way of example, as illustrated in FIG. 4, ruthenium was deposited on graphite substrate at a loading of about 250 μg/cm$^2$. The electrodeposited ruthenium metal was then converted to $RuO_2$ by annealing in air at 400° C. for 18 hours.

Other methods can also be used to provide an electrochemically active coating including a transition metal oxide (e.g., $RuO_2$) on a portion of the surface of the graphite substrate. Such methods can include physical vapor deposition and chemical vapor deposition methods, such as sintering and sputtering a transition metal oxide (e.g., $RuO_2$) on the graphite substrate, as well as by thermal decomposition of a precursor solution containing a transition metal, such as trivalent ruthenium, deposited by, for example, dip coating, on the graphite substrate. Sputter coating and sintering can advantageously produce densely packed and adherent layers with a certain degree of crystal structure tunability. The advantage of chemically oxidizing trivalent ruthenium is simplicity and expediency in experimental setup and procedure.

In some embodiments, the dimensionally stable anode described herein can be used in a system and process for the production, extraction, or recovery metal(s) by electrowinning and particularly non-aqueous chloride molten salt electrolysis. Chloride molten salt electrolysis can provide high-efficiency production of solid metal or liquid metal while evolving chlorine ($Cl_2$) gas. Metal produced by the molten salt electrolysis can be recovered and $Cl_2$ gas can optionally be recycled in a chlorination process. Advantageously, the dimensionally stable anode when used in the chloride molten salt electrolysis is catalytic to $Cl_2$ gas generation, which prevents large overpotential and suppresses side reactions. This can enable the use mixed halide electrolytes, such as Cl and F electrolytes, that only produce $Cl_2$ during molten salt electrolysis.

For example, a molten salt electrolysis processes for neodymium production using chloride containing salts and fluoride containing salts can generate perfluorocarbons via reaction with between the graphite anode and fluoride containing electrolyte. Using the dimensionally stable anode described herein that includes a chlorine reactive coating, $Cl_2$ production can be enhanced and perfluorocarbon or $F_2$ production can be suppressed at the anode allowing use of fluoride salts, such as $CaF_2$, in the electrolyte.

In some embodiments, a dimensionally stable anode and a cathode can be provided in a chloride based molten salt electrolyte contained in an electrochemical cell of a molten salt electrolysis reactor for producing metal(s) and chlorine gas from a metal chloride feedstock in moderate or high-temperature chloride molten salt electrolysis. An electrical potential is applied between the cathode and the anode of an electrochemical cell so that the metal chloride dissolved in the chloride based molten salt is electrolyzed, the metal product(s) is electrodeposited on the cathode of the cell, and $Cl_2$ gas is generated at the anode of the reactor In some embodiments, metal cathode product(s) can include at least one of alkali metal, alkaline earth metal, transition metal, post-transition metal, metalloid/semi-metal, lanthanoid/lanthanide, actinoid/actinide, or combinations thereof. The cathode product(s) can be in solid, liquid, or gas phase.

In some embodiments, the electrochemical cell or chamber of the molten salt electrolysis reactor can be defined by a container or vessel fabricated from a ceramic, such as alumina, or a high-temperature corrosion-resistant metal, such as Hastelloy or Inconel. Other high-temperature corrosion-resistant materials, such as siliceous refractory material can also be used.

In some embodiments, the cathode includes an inert metal, such as tungsten or molybdenum.

In some embodiments, a current source can provide current effective for molten salt electrolysis of the metal chloride(s) to metal and chlorine gas. For example, the anode and cathode can be electrically connected to current source that can provide an operating current density (current applied per unit of electrode surface area) of about 50 to about 1,000 A/cm$^2$.

In some embodiments, the anode produces chlorine gas without the interruption of current from external electrical circuitry for any period of time exceeding 1 second.

In other embodiments, the cathode product(s) are produced without the interruption of current from external electrical circuitry for any period of time exceeding 1 second.

In some embodiments, the anode and cathode are separated from one another in the electrochemical cell, such as a batch electrochemical cell. In such a configuration, the batch electrochemical cell can further include a separator or diaphragm positioned between and separating the anode and the cathode. The separator or diaphragm can inhibit redox shuttling and back reaction between metal plated on the cathode and chlorine gas generated at the anode. The separator or diaphragm can include, for example, a ceramic with a porosity of about 10% to about 60%.

In some embodiments, the chloride based molten salt electrolyte can include a molten mixture of at least about 50.00 mol % chloride containing fused salts where the balance of the fused salt mixture may be a single electrolyte or mixture of electrolytes where the anion is a carbonate, sulfate, phosphate, fluoride, bromide, iodide, or hydroxide.

In other embodiments, the chloride based molten salt electrolyte can include a molten mixture of at least about 50.00 mol % chloride containing fused salts where the balance of the fused salt mixture may be an inorganic compound of the oxide, nitride, carbide, phosphide, or sulfide variety.

In some embodiments, the molten mixture can include chemically bound or unbound water molecules.

In some embodiments, the chloride containing fused salts provided in the electrochemical cell and in which the metal chloride is dissolved can include chlorides of alkaline metals and alkaline earth metals, such as chlorides of Li, Na, K, Rb, Cs, Mg, Ca, Sr, Ba either pure or in mixtures, such as eutectic mixtures.

In some embodiments, the chloride containing fused salts can include a moderate temperature chloride containing fused salts. The moderate temperature chloride containing fused salts can include a eutectic of at least two of LiCl, KCl, NaCl, CsCl, $MgCl_2$, $BaCl_2$, $SrCl_2$, or $CaCl_2$. For example, a eutectic of about 55%-60% LiCl and 45%-40% KCl can have a melting point of about 475° C.-575° C., a eutectic of 27%-98% NaCl and 73%-2% $SrCl_2$ can have a melting point of about 650° C.-800° C., a eutectic of about 66% NaCl and 34% $MgCl_2$ can have a melting point of about 750° C., a eutectic of about 85%-98% NaCl and about 15%-2% $BaCl_2$ can have a melting point of about 750° C.-800° C., a eutectic of about 30%-50% NaCl and about 70%-50% $CaCl_2$ can have a melting point of about 700° C.-750° C., a eutectic of about 50% NaCl and 50% KCl can have a melting point of about 750° C., a eutectic of about 67% KCl and 33% $CaCl_2$ can have a melting point of about 700° C., a eutectic of about 24% NaCl, 41% KCl, and 35% $BaCl_2$ can have a melting point of about 650° C., and a eutectic of about 40%-70% LiCl, 0-20% NaCl and about 25%-55% KCl can have a melting point of about 450° C.-600° C.

In some embodiments, the moderated temperature molten salt electrolysis can be conducted at a temperature of about 400° C. to about 800° C., for example, about 400° C. to about 750° C., about 400° C. to about 700° C., about 400° C. to about 650° C., about 400° C. to about 600° C., about 400° C. to about 550° C., about 400° C. to about 500° C., about 450° C. to about 800° C., about 500° C. to about 800° C., about 550° C. to about 800° C., about 600° C. to about 800° C., about 650° C. to about 800° C., or about 700° C. to about 800° C.

In other embodiments, the chloride containing fused salts can include high temperature chloride containing fused salts. The high temperature chloride containing fused salt electrolyte can include a eutectic of $SrCl_2$, $BaCl_2$, and optionally at least one of LiCl, KCl, NaCl, CsCl, $MgCl_2$, or $CaCl_2$. For example, a eutectic of about 54% KCl and 46% $BaCl_2$ can have a melting point of about 825° C. and a eutectic of about 30% $BaCl_2$ and about 70% $SrCl_2$ can have a melting point of about 847° C.

In some embodiments, the high temperature molten salt electrolysis can be conducted at a temperature of at least about 800° C., for example, at least about 850° C., at least about 900° C., at least about 950° C., at least about 1000° C., at least about 1050° C., at least about 1100° C., at least about 1150° C., at least about 1200° C., about 825° C. to about 1200° C., about 850° C. to about 1200° C., about 900° C. to about 1200° C., about 950° C. to about 1200° C., about 1000° C. to about 1200° C., about 825° C. to about 1150° C., about 825° C. to about 1100° C., about 825° C. to about 1050° C., about 825° C. to about 1000° C., about 825° C. to about 950° C., or about 825° C. to about 900° C.

One example of a molten salt electrolyte that can be used in molten salt electrolysis of the metal chloride is a melt or the binary eutectic mixture of NaCl and KCl (NaCl—KCl in the 50:50 mole percent ratio) and $CaF_2$.

In some embodiments, the electrolysis can be conducted at a current density of about 50 mA/cm$^2$ to about 1,000 A/cm$^2$. For example, typically, at current densities in the 0.2-0.4 A/cm$^2$ range, Nd electrowon using such melts deposits as dendritic sponge on a tungsten or molybdenum cathode.

The temperature of molten salt electrolyte in the molten salt electrolysis can be adjusted in accordance with the type of molten salt electrolyte used. For example, the temperature during molten salt electrolysis can range from about 25° C. to about 3000° C.

The electrochemical cell of a molten salt electrolysis reactor can include any number of cell configurations, such as a cell with a single electrolysis chamber that includes a single anode and a single cathode, a cell with multiple anodes and cathodes, a cell that includes heterogenous bipolar electrodes, and a cell with multiple chambers each, which includes anodes and cathodes separated by junctions or membranes.

Figure 2:
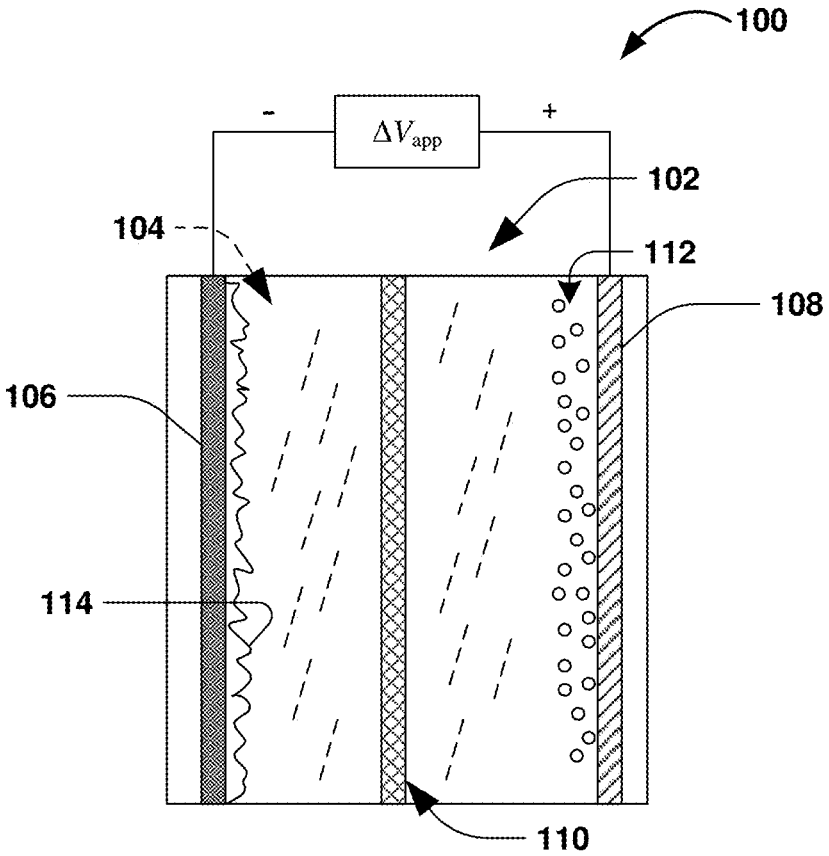
FIG. 2 is a schematic illustration of a electrochemical cell that includes a dimensionally stable anode in accordance with an embodiment.

FIG. 2 illustrates an electrochemical cell 100 suited for moderate temperature batch operation that allows recovery of solid metal electrodeposited on the cathode surface. The electrochemical cell 100 includes a electrolysis chamber 102 that contains a moderate temperature chloride based molten salt electrolyte 104, such as LiCl—KCl, NaCl—KCl or other eutectic mixtures, in which the metal chloride (e.g., $NdCl_3$ or $FeCl_3$) is dissolved as well as a vertically-aligned flat-plate cathode 106 and the dimensionally stable anode 108 described herein to which an electric potential can be applied. The cathode 106 and anode 108 can be provided in other configurations, such as concentric annular electrodes. The cathode 106 and anode 108 are separated from one another in the electrochemical cell 100 by a porous partition wall 110, such as separator or diaphragm 110 positioned between and separating the cathode 106 and anode 108. The separator or diaphragm 110 can inhibit redox shuttling and back reaction between metal plated on the cathode 106 and $Cl_2$ gas 112 generated at the anode 108. The separator or diaphragm 110 can include, for example, a ceramic with a porosity of about 10% to about 60%.

FIG. 2 show that a molten metal chloride, such as $NdCl_3$, dissolved in the moderate temperature metal molten salt electrolyte 104, such as LiCl—KCl, NaCl—KCl or other eutectic mixtures, can be electrodeposited at moderate temperatures (e.g., about 475° C.-500° C.) as a solid dendritic metal sponge 114 on a surface of a tungsten or molybdenum cathode 106 while $Cl_2$ gas 112 evolution is facilitated on the dimensionally stable anode 108. The deposited Nd can be recovered by scraping the Nd from the surface of the cathode 106. The $Cl_2$ gas 112 generated at the anode 108 during Nd electrowinning can be recycled.

Figure 3:
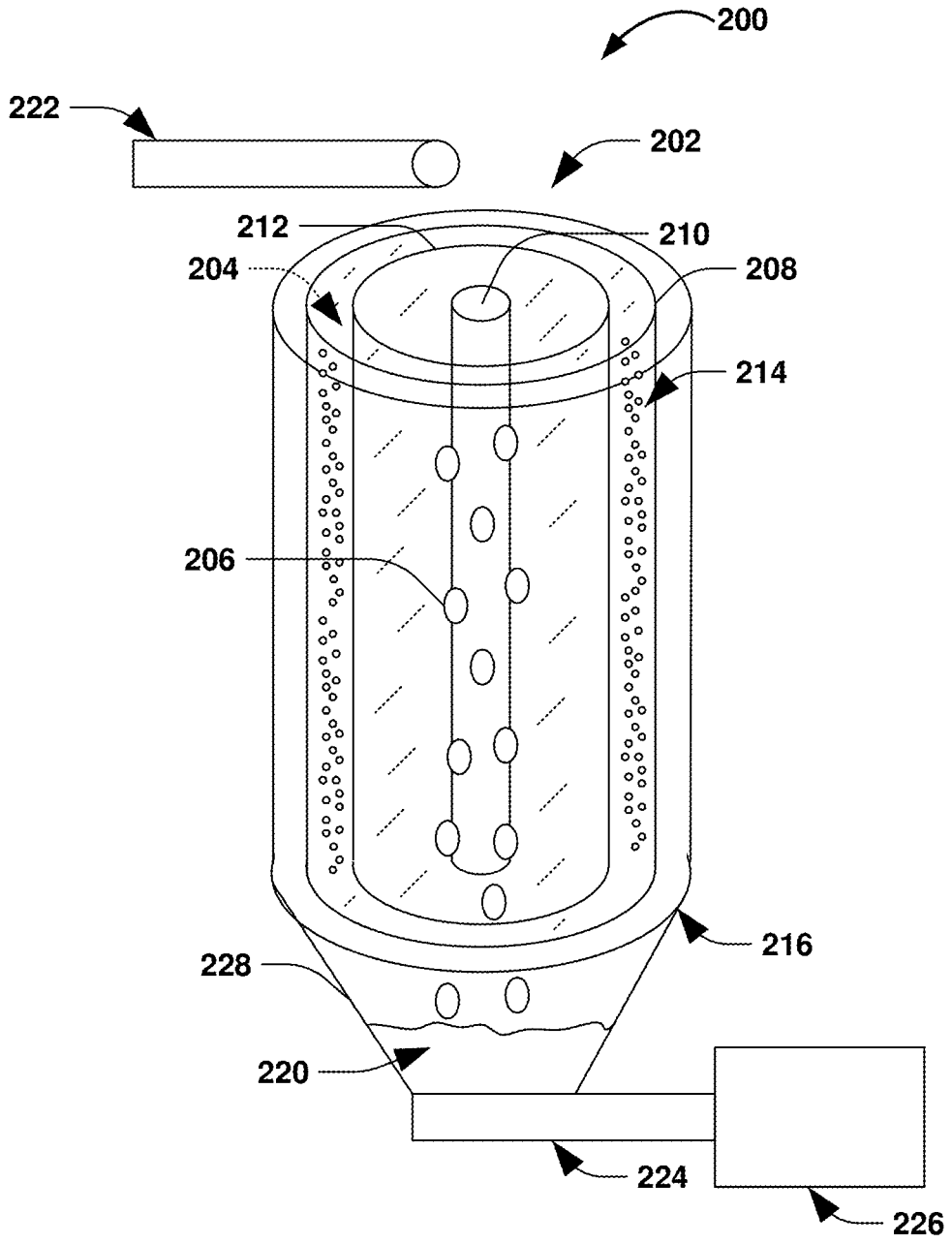
FIG. 3 is a schematic illustration of a electrochemical reactor for continuous production of molten rare earth elements or rear earth element containing alloys.

FIG. 3 illustrates an example of an electrochemical cell 200 suited for higher temperature continuous molten salt electrolysis operation that allows recovery of molten metal electrodeposited on the cathode surface. The continuous electrolysis can include continuous input of metal containing feedstock into the cell, continuous production of chlorine gas and metal cathode product(s), and continuous collection of the produced metal cathode product(s) from the cell.

The electrochemical cell 200 includes an electrolysis chamber 202 that contains a high temperature (e.g., greater than 800° C.) chloride based molten salt electrolyte 204, for example, $BaCl_2$—$SrCl_2$ or other eutectic mixtures, in which a metal chloride feedstock (e.g., $NdCl_3$ or $FeCl_3$) is continuously input.

The density of the high temperature chloride based molten salt electrolyte 204 can be different (e.g., lower) than the metal 206 electrodeposited from the metal chloride so that molten electrodeposited metal 206 (e.g., Nd or Fe) can separate from the chloride based molten salt electrolyte 204 in the cell upon electrodeposition. The electrochemical cell 200 can also include concentric annular dimensionally stable anode 208 that surrounds a refractory cathode rod 210. The geometric surface area ratio of anode to cathode can be about 0.5:1 to about 1000:1.

The concentric annular anode 208 and refractory cathode rod 210 are separated from one another in the electrochemical cell 200 by a porous partition wall 212, such as separator or diaphragm 212 positioned between and separating the cathode 208 and anode 210. The separator or diaphragm 212 can inhibit redox shuttling and back reaction between metal 206 plated on the cathode 210 and chlorine gas 214 generated at the anode 208. The separator or diaphragm 212 can include a ceramic with a porosity of about 10% to about 60%.

The refractory cathode rod 210 can be orthogonal or oblique to a bottom 216 of the electrochemical cell 200 so that molten metal 206 electrodeposited on the cathode surface flows through the less dense molten salt electrolyte to an molten metal pool 220 at the bottom of the cell 200 and $Cl_2$ gas 214 generated by electrolysis at the anode surfaces flows to a $Cl_2$ removing channel (not shown) at the top of the cell 200.

In some embodiments, the electrochemical cell includes a means (not shown) for supplying current effective for molten salt electrolysis of the metal chloride(s) to metal and chlorine gas. The current means can supply current at a current density of about 50 $mA/cm^2$ to about 1,000 $A/cm^2$.

The continuous input of feedstock salts can be achieved through an input device 222, such as a refractory ceramic or metal screw feeder or conveyer or funneling system or slider bearing type assembly whereby the rate of input of the metal containing feedstock can be modulated to increase, decrease or maintain bulk concentration based on optimizing reaction conditions for higher throughput, or conditions. For example, the rate of input of the metal containing feedstock can be modulated to optimize production of metal cathode product(s) and optionally chlorine gas.

An example feedstock can include transition metals, transition metal oxides, lanthanide metals, lanthanide metal oxides, post-transition metals, post-transition metal oxides, metalloids, and metalloid oxides whereby the metals to continuously electrowon may be first converted into an inorganic compound of the oxide, nitride, halide, nitrate, sulfate, hydroxide, sulfide, chlorate, carbonate, phosphate, chlorite, or other variety. The metals to be continuously electrowon are then solvated or dissolved or suspended in the chloride based molten salt electrolyte where they may exist in ionic or complex ionic form or as a suspended inorganic molecule and may be reduced at a cathode continuously either by accepting electrons from a polarized cathode directly or by discharging previously attached anions through accepting electrons from a polarized cathode.

The continuous collection of the metal cathode product(s) can minimize the metal cathode product(s) contact with cations of the same metal while not be being held under a deposition potential. The continuous collection metal cathode product(s) can be achieved by drawing, valving, pumping, capillary feed, or slider bearing like mechanisms utilizing similar aforementioned materials of construction for the reactor lining, collection vessel and apparatus utilized for tapping or valving, pumping or slider bearing type assembly. For example, the molten metal pool 220 can be fluidly connected to a collection system 224, such as a refractory valve or spout controlled by a stepper motor 226 or similar control system, which siphons accumulating metal in a collection basin 228 formed during molten salt electrolysis.

Another method by which continuous drawing of metal cathode product(s) can be achieved is by use of a refractory metal or ceramic which does not combine chemically with the metallic material which is allowed to fuse in a tube of the refractory material and subsequently drawn off by induction remelting under inert blanket, vacuum or under air atmospheres.

Although various embodiments are specifically illustrated and described herein, it will be appreciated that modifications and variations of the present invention are covered by the above teachings and are within the purview of the appended claims without departing from the spirit and intended scope of the invention.

The invention is further illustrated by the following example, which is not intended to limit the scope of the claims.

EXAMPLE

This example describes the fabrication and characterization of a dimensionally stable anode that includes a plate-shaped graphite substrate at least partially coated with a transition metal oxide, such as $RuO_2$.

Figure 5:
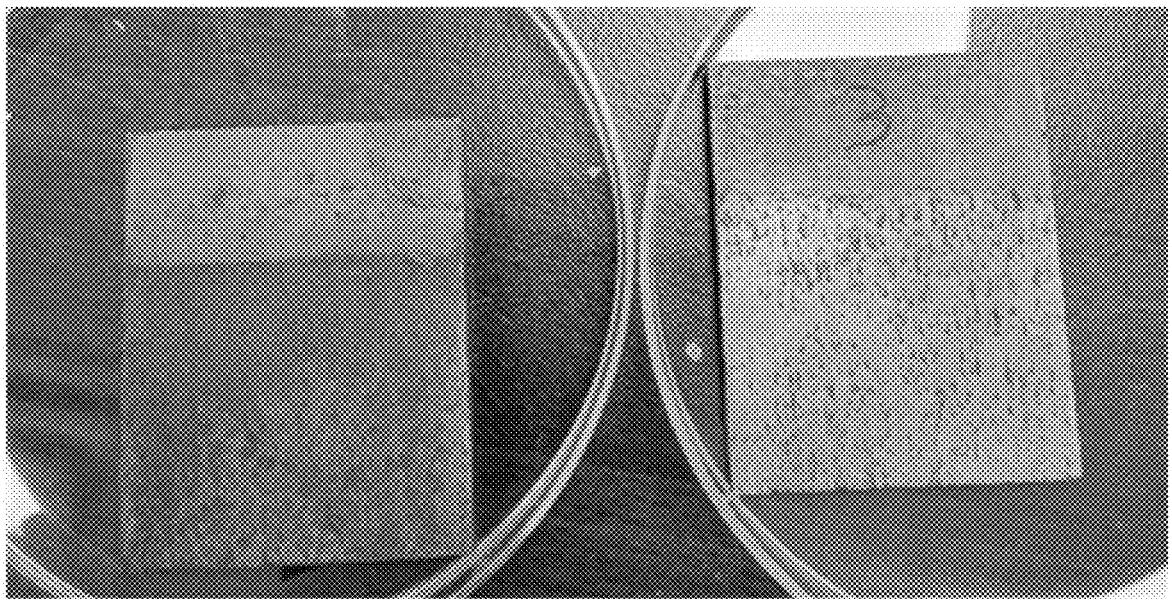
FIG. 5 is an image of ruthenium plated on a graphite substrate with (right) and without (left) annealing in air.

Ruthenium metal was deposited onto the graphite substrate at a loading of approximately 250 μg/cm$^2$. The metal was then converted to oxide through annealing in air at 400 C for 18 hours. As can be seen in FIG. 5, the electrode appears to have a uniform ruthenium coverage prior to annealing (right) and coverage remains uniform but changes to a bluish color indicating ruthenium oxide after annealing (left).

Figure 6:
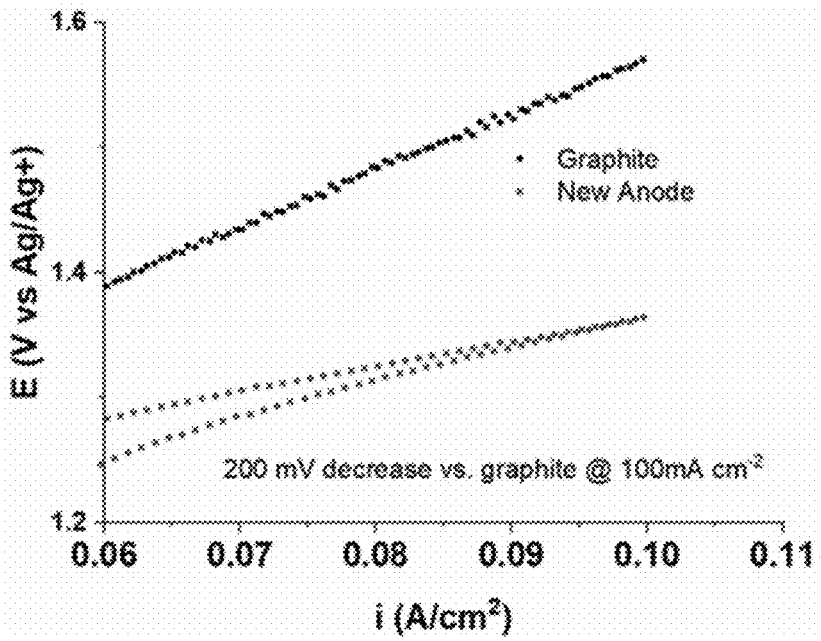
FIG. 6 is a plot comparing anode potential of G-$RuO_2$ anode and pure graphite anode vs. Ag/AgCl reference electrode [1 wt. % AgCl in KCl—LiCl (55:45 wt. %)]
Figure 7:
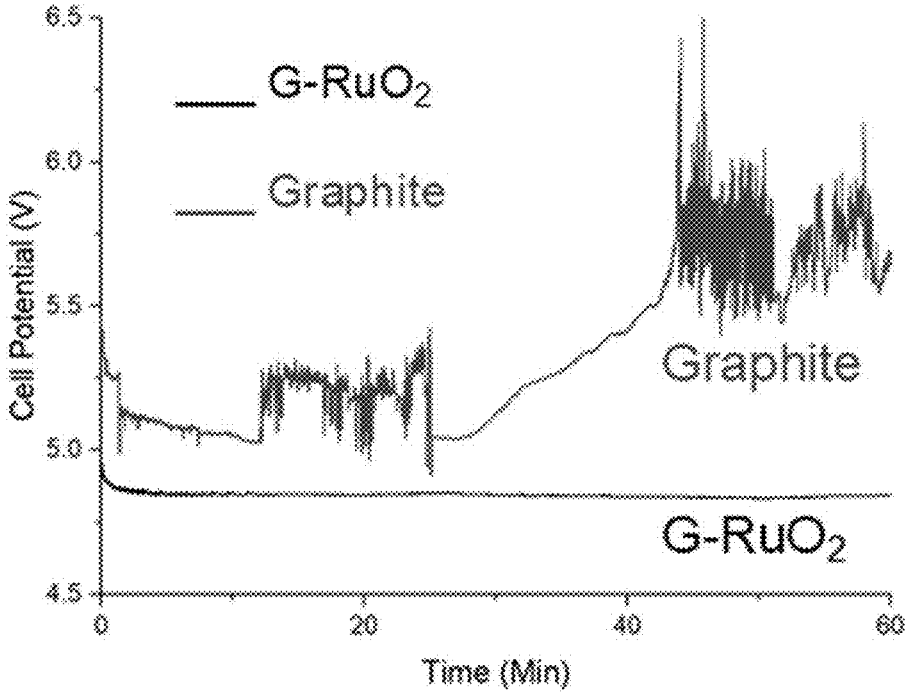
FIG. 7 is a plot showing cell voltage during constant current (250 $mA/cm^2$) Nd sponge deposition at 475° C. in an electrochemical cell employing a G-$RuO_2$ anode and a bare graphite anode.

These second generation G-$RuO_2$ anodes were used in the electrolysis of Nd solid sponge and showed lower and more stable cell voltage during a 1-hour electrolysis at 250 mA/cm$^2$ and 475° C. than bare graphite operated under the same conditions. The corresponding electrolysis cell voltage traces can be seen in FIGS. 6 and 7.

Characterization of DSAs following operation in molten salts was performed to understand how the coatings are modified or degrade during their service life. XRD measurements revealed that at the coatings are unchanged. The $RuO_2$ coating does not significantly degrade, demonstrating that the surface layers are robust under service conditions.

In addition, the surface morphology of the samples was characterized using SEM and EDS to map chemical changes. As with XRD, these measurements showed plating of NdOCl onto the anodes with many Nd-rich plates covering the surface. There was no evidence of delamination or other degradation of the underlying $RuO_2$ surface.

From the above description, those skilled in the art will perceive improvements, changes and modifications. Such improvements, changes and modifications within the skill of the art are intended to be covered by the appended claims.

Having described the invention, the following is claimed:

1. An electrochemical cell for electrolytically generating chlorine gas and one or more metal cathode product(s) comprising:

a dimensionally stable anode comprising a graphite substrate and a coating that consist of $RuO_2$ and optionally $IrO_2$ disposed on the substrate, and a cathode positioned in a molten mixture of at least 50 mol % chloride containing fused salts, wherein during electrolysis chlorine gas is produced at the anode and metal cathode product(s) are produced at the cathode, and wherein the metal cathode product(s) comprise neodymium.

2. The electrochemical cell of claim 1, being configured for continuous electrolysis.

3. The electrochemical cell of claim 2, wherein the continuous electrolysis includes continuous input of metal containing feedstock into the cell, continuous production of chlorine gas and metal cathode product(s), and continuous collection of the produced metal cathode product(s) from the cell.

4. The electrochemical cell of claim 3, wherein the rate of input of the metal containing feedstock is modulated to optimize production of metal cathode product(s) and optionally chlorine gas.

5. The electrochemical cell of claim 3, wherein the continuous collection of the metal cathode product(s) minimizes the metal cathode product(s) contact with cations of the same metal while not be being held under a deposition potential.

6. The electrochemical cell of claim 1, wherein balance of the fused salt comprises a single electrolyte or mixture of electrolytes where the anion is a carbonate, sulfate, phosphate, fluoride, bromide, iodide, or hydroxide.

7. The electrochemical cell of claim 1, wherein balance of the fused salt comprises at least one of an inorganic oxide, nitride, carbide, phosphide, or sulfide.

8. The electrochemical cell of claim 1, wherein the molten mixture includes a eutectic of at least two of LiCl, KCl, NaCl, CsCl, $MgCl_2$, $BaCl_2$, $SrCl_2$, or $CaCl_2$) and the electrolysis is conducted at a temperature of about 400° C. to about 800° C.

9. The electrochemical cell of claim 1, wherein the molten mixture includes a eutectic of $SrCl_2$, $BaCl_2$, and optionally at least one of LiCl, KCl, NaCl, CsCl, $MgCl_2$, or $CaCl_2$) and the electrolysis is conducted at a temperature of about 800° C. to about 3000° C.

10. The electrochemical cell of claim 1, wherein the anode produces chlorine gas without interruption of current from external electrical circuitry for any period of time exceeding 1 second.

11. The electrochemical cell of claim 3, wherein the metal containing feedstock is $NdCl_3$.

* * * * *